United States Patent [19]

Stoffel

[11] Patent Number: 4,485,935

[45] Date of Patent: Dec. 4, 1984

[54] EASY-OPEN STRUCTURE FOR CONTAINERS AND METHOD OF FORMING THE SAME

[75] Inventor: Hans F. Stoffel, Rye, N.Y.

[73] Assignee: Stoffel Technologies, Inc., Tuckahoe, N.Y.

[21] Appl. No.: 448,037

[22] Filed: Dec. 8, 1982

[51] Int. Cl.[3] ..... F23Q 7/22

[52] U.S. Cl. ..... 220/270; 413/14

[58] Field of Search ..... 220/270; 413/14, 66, 413/56

[56] References Cited

U.S. PATENT DOCUMENTS

| | | | |
|---|---|---|---|
| D. 212,595 | 11/1968 | Saunders . | |
| D. 219,370 | 12/1970 | Weirton . | |
| D. 226,071 | 1/1973 | Saunders et al. . | |
| D. 226,072 | 11/1968 | Saunders et al. . | |
| 1,664,515 | 4/1928 | Lambert . | |
| 2,034,007 | 3/1931 | Smith . | |
| 2,574,720 | 11/1951 | Trait et al. . | |
| 2,792,145 | 5/1957 | Sowter . | |
| 3,084,835 | 4/1963 | Walsh | 222/541 |
| 3,325,043 | 6/1967 | Henchert et al. | 220/270 |
| 3,334,778 | 8/1967 | Saunders | 220/269 |
| 3,363,798 | 1/1961 | Garangiotis | 220/41 |
| 3,454,190 | 7/1969 | Miki | 220/269 |
| 3,483,355 | 12/1969 | Murdock | 219/437 |
| 3,946,896 | 3/1976 | Lemelson | 220/273 |
| 3,980,201 | 9/1976 | Keiji | 220/270 |
| 4,152,573 | 5/1979 | Saurin | 219/121 L |
| 4,182,460 | 1/1980 | Holls et al. | 220/271 |
| 4,203,528 | 5/1980 | Hasegawa | 220/269 |
| 4,207,991 | 6/1980 | Anabili | 220/269 |
| 4,257,529 | 3/1981 | Saunders | 220/269 |
| 4,289,250 | 9/1981 | Jordan | 220/269 |

FOREIGN PATENT DOCUMENTS 593757 11/1975 Switzerland .

OTHER PUBLICATIONS

"The Industrial Laser–A Special Tool for Special Needs" by Margaret A. Maas, *Electronics*, Apr. 29, 1976, pp. 89–96.

*Primary Examiner*—Leon Gilden

*Attorney, Agent, or Firm*—Antonelli, Terry & Wands

[57] ABSTRACT

An easy-open structure for containers and a method of forming the same are disclosed. The easy-open structure comprises a sheet material container wall panel having a scoreline formed therein outlining a movable wall portion to be moved out of conforming contour with the remainder of the sheet material wall panel, and an elongated tab opener for moving the movable wall portion out of conforming contour with the remainder of the wall panel. The tab opener is welded to the movable wall portion with a high energy density welding process wherein the energy density is at least on the order of $10^6$ watts/inch$^2$. Preferably the welding is accomplished by laser welding.

40 Claims, 22 Drawing Figures

FIG. 4.
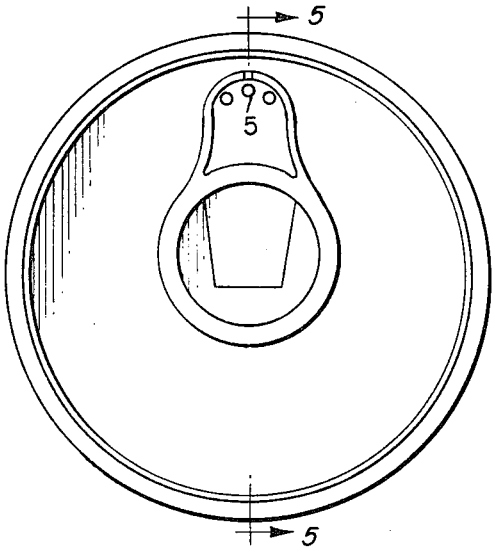
FIG. 5.
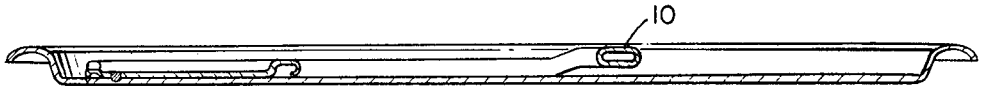
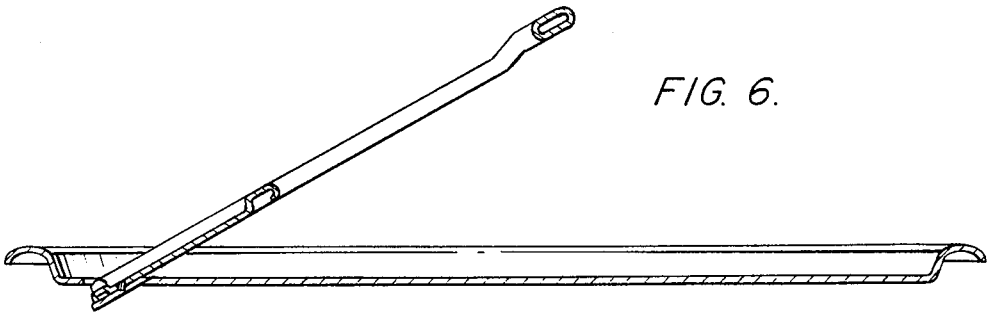
FIG. 6.
FIG. 7.
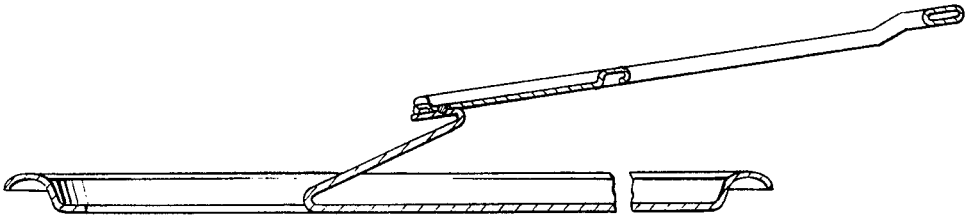

FIG. 16.
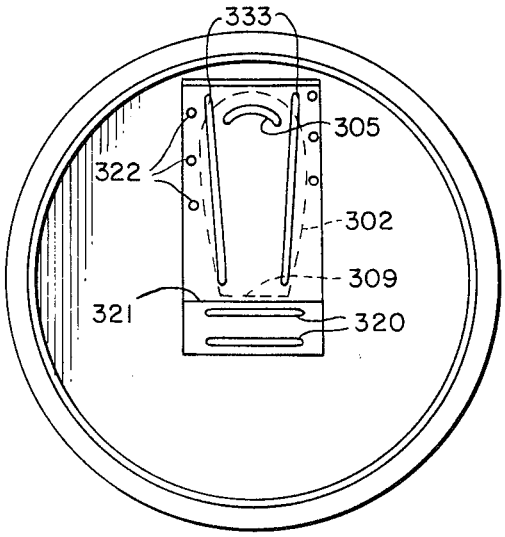
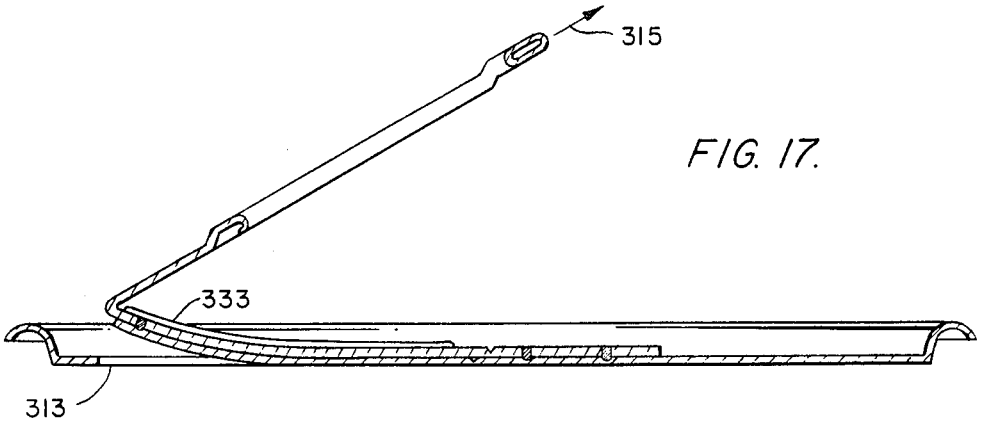
FIG. 17.
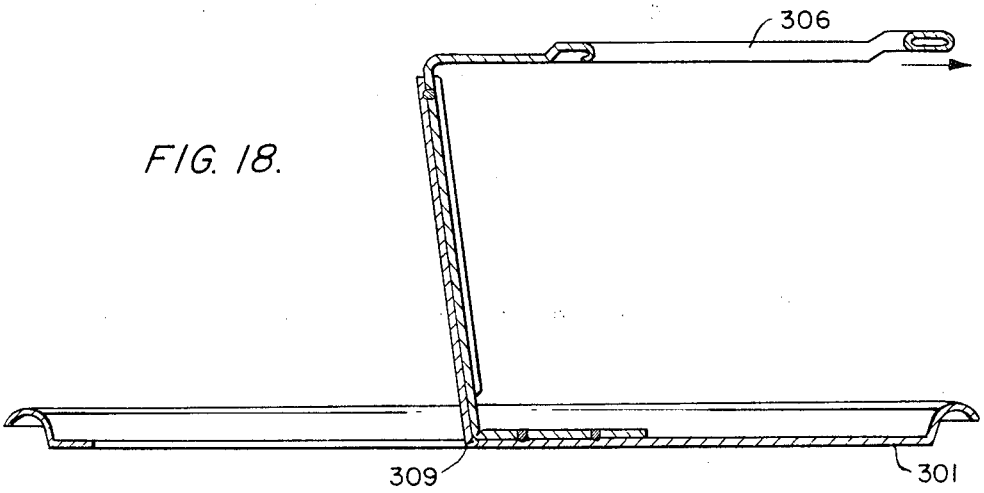
FIG. 18.

EASY-OPEN STRUCTURE FOR CONTAINERS AND METHOD OF FORMING THE SAME

BACKGROUND AND SUMMARY OF THE INVENTION

The present invention is directed to an easy-open structure for containers and a method of forming the same. More particularly, the invention relates to an easy-open structure for containers and a method of forming the same wherein a sheet material container wall panel such as a container end has a scoreline formed therein outlining a movable wall portion adapted to be moved out of conforming contour with the remainder of the sheet material wall panel with an elongated tab opener.

In known, commercially-used, easy-open structures for containers of the aforementioned type, the tab opener is generally secured to the sheet material container wall panel by a rivet head which is press formed from the sheet material wall panel as in U.S. Pat. No. 4,257,529, for example. In such arrangements, the tab opener functions as a lever during opening when a handle end of the tab opener is lifted to pivot the tab opener vertically about the rivet which serves as the fulcrum. The space requirements and stresses placed upon the sheet material during rivet formation prevent the rivet from being located in close spaced relationship to a portion of the scoreline where tearing is initiated with movement of the tab opener. This results in a relatively low mechanical advantage lever action where the length of the tab opener is limited by space and/or cost requirements. The relatively large size of the rivet head also adversely effects the mechanical advantage of the lever action. Thus, these known structures are disadvantageous in that they can be relatively difficult to open, requiring the application of considerable force to lift the tab opener. The relatively small size of the handle end of the tab opener in proportion to the size of the tab opener can also make it difficult to open. The use of a rivet to secure the tab opener to the container wall panel is further disadvantageous in that it imposes restrictions on the type of material that can be used for the sheet material wall panel. That is, a material must be relatively soft or ductile to form a rivet head therein thereby precluding the use of relatively hard, higher strength materials and requiring the use of relatively thick sheet material to meet minimum strength requirements. In addition, in those applications where it is required to coat the inside of the easy-open container end, press forming the rivets can damage the coating on the end thereby necessitating a coating operation after the tab opener is joined to the end.

There have been attempts to avoid some or all of the aforementioned disadvantages associated with the use of rivet connections between tab openers and associated container wall panels. In U.S. Pat. Nos. 3,084,835 and 3,334,778, for example, structures and methods are disclosed wherein the tab opener is electrically resistance spot welded to the container wall panel. However, electrical resistance spot welding has not been widely adopted by the industry, in part, because of the difficulty in controlling the weld quality, the large heat affected zone causes weakness around the weld spot, and the necessity of using current conducting electrodes to forceably engage the workpieces at the weld zone. Such electrodes can be easily contaminated by various coatings. Coatings frequently present on the workpieces may also prohibit the use of electrical resistance spot welding such as with tin free steel due to the high resistance surface. Where coated workpieces can be resistance spot welded, undesirable damage to the coating can occur thus requiring a repair or postweld coating operation.

Another method which has been proposed is to join the tab opener to the container wall panel by drawn arc welding as in U.S. Pat. No. 3,483,355. However, such a method requires the additional manufacturing step of forming an attaching dimple or projection in the tab opener in order to localize the welding current at a single spot to effect welding. The heat effected zone from this process is also quite large and damaging to spot strength. A coating on the inner surface of the container wall panel can also be damaged during such a process thereby making it necessary to employ a coating operation subsequent to welding.

An object of the present invention is to provide an improved easy-open structure for containers of the aforementioned type and a method of forming the same which avoid the above-discussed problems associated with rivet attachment and the known alternatives thereto. More particularly, an object of the present invention is to provide an easy-open structure for containers of the type described which provides greater mechanical advantage lever action during tear initiation than the riveted structures and is therefore easier to open.

A further object of the invention is to provide an easy-open structure for containers which need not be formed from the soft, ductile materials necessary for rivet-formation so that harder, higher strength materials can be employed thereby permitting the use of thinner materials and reducing costs.

An additional object of the invention is to provide a method of forming an improved easy-open structure for containers which can be used to join plain or coated workpieces in most instances, including those with non-conductive or high resistive coatings, and which can be used to join such workpieces without damaging a coating on the inner surface of the container wall panel thereby eliminating the requirement of a coating operation subsequent to welding.

These and other objects are attained by the method of forming an easy-open structure for containers according to the invention which comprises the steps of providing a sheet material wall panel having a scoreline formed therein outlining a movable wall portion which is adopted to be moved out of conforming contour with the remainder of the sheet material wall panel, providing a tab opener for moving the movable wall portion out of conforming contour with the remainder of the wall panel, and welding the tab opener to the movable wall portion with a high energy density welding process wherein the energy density is at least on the order of $10^6$ watts/inch$^2$. According to a preferred embodiment of the invention, the high energy density welding process is a laser welding process.

The high intensity or energy density, at least on the order of $10^6$ watts/inch$^2$, which can be achieved by optically focusing a laser beam permits very rapid welding of the tab opener to the movable wall portion of the sheet material wall panel and produces only a relatively small weld heat affected zone thereby minimizing degradation of sheet material properties during welding as compared with those welding techniques which have heretofore been employed or proposed in forming easy-open structures for containers. These advantages, and the ability to focus the laser beam to a relatively small spot size, such as 0.010 inch diameter or less, as well as the fact that there is no need for mechanical contact of any kind with the workpiece in the immediate weld area, enable the weld area to be in close spaced relationship to a portion of the scoreline where tearing is initiated with movement of the tab opener. This permits the mechanical advantage of the lever action to be increased thereby making it easier to open the container. According to a disclosed embodiment the weld area is located within approximately ⅛th inch or less from the scoreline. Coated workpieces can be laser welded in most instances. The laser can also be precisely controlled so that a tab opener can be welded to the outer side of a movable wall portion of a sheet material wall panel without damaging a coating on the inner side thereof. In this latter case the weld penetration extends only partially through the thickness of the wall portion and postweld coating of the inner side of the wall panel can be avoided.

An improved easy-open structure for containers according to one embodiment of the invention comprises a sheet metal container wall panel having a scoreline formed therein outlining a movable wall portion to be moved out of conforming contour with the remainder of the sheet metal wall panel, and an elongated tab opener for moving the movable wall portion out of conforming contour with the remainder of the wall panel. The tab opener is welded to the movable wall portion at an elongated weld area extending transverse to the longitudinal direction of the tab opener and in close spaced relationship to a portion of the scoreline where tearing is initiated with movement of the tab opener. The elongated weld area is formed by a high energy density welding process, that is, laser welding, wherein the energy density is at least on the order of $10^6$ watts/inch$^2$.

By providing an elongated weld area between the tab opener and the wall panel, it is possible to reduce the size of the connection from a single, relatively large diameter annular rivet or weld to a relatively narrower elongated connection or weld area which enhances the mechanical advantage of the lever action and ensures proper alignment of the force at the working end of the tab opener, in the case of Class 1 lever action, for example. With laser welding the welds can also be consistently placed in close spaced relationship to the scoreline to maximize the mechanical advantage of the lever action and no special surface indentations in the tab opener are required to localize the welding energy.

According to one form of the invention, the elongated weld area includes a continuous elongated laser weld which extends transverse to the longitudinal direction of the tab opener. In another form of the invention the elongated weld area includes a plurality of laser welds positioned in spaced relationship along the length of the weld area.

In several of the disclosed embodiments, one end of the elongated tab opener serves as a handle for moving the movable wall portion out of conforming contour with the remainder of the sheet the other end is a working end which is positioned over a portion of the scoreline where tearing is initiated. The tab opener is welded to the movable wall portion at an elongated weld area which is positioned in close spaced relationship to the working end of the tab opener and which serves as a fulcrum so that tearing can be initiated along the scoreline by Class 1 lever action with a relatively high mechanical advantage by lifting the handle end of the tab opener. The handle end of the tab opener is generally circular in form and has a central aperture through which a finger may be inserted after the handle end of the tab opener has been initially lifted.

As an additional feature, the easy-open structure for containers of the invention can be provided with means for venting the container as the handle end of the opener is lifted. In one disclosed embodiment the means for venting includes an additional weld area connecting the tab opener to a vent portion of the movable wall portion between the elongated weld area and the handle end of the tab opener whereby the vent portion is torn from the movable wall portion by a Class 2 lever action to vent the container upon lifting the handle end of the tab opener. An additional scoreline may be formed in the movable wall portion around this additional weld area to outline the vent portion. Rupture occurs along this additional scoreline when the vent portion is torn from the movable wall portion.

In one form of the invention the wall panel is a container end and the movable wall portion thereof extends over essentially the entire container end. The movable wall portion is completely circumscribed by a scoreline so that it may be removed from the container end. In another form of the invention the wall panel is a container end and the movable wall portion is in the form of a tab which encompasses only a portion of the container end so as to define a drinking or pouring opening in the case of a beverage can, for example. The scoreline does not completely circumscribe the tab so that a hinge metal portion remaining for retaining the tab and tab opener on the container end after opening.

As another feature of the invention the score line may be formed essentially or entirely through the thickness of the sheet metal container wall panel so that the movable wall portion can be easily moved out of conforming contour with the remainder of the sheet metal wall panel. A coating can be applied to at least the inner side of the sheet metal container wall panel in the area of the scoreline for resisting leakage through the container wall panel at the scoreline. To resist undesired outward or inward movement of the movable wall portion from pressures within a container, the tab opener is welded to the sheet metal container wall panel at a plurality of spaced locations about the movable wall portion by means of a high energy density welding process. The weld sizes at the spaced locations are relatively small to allow breaking thereof during opening. In one such embodiment the easy-open structure for containers comprises a tab opener which is provided with handle means adjacent one end thereof for moving the movable wall portion out of conforming contour with the remainder of the sheet material wall panel, the tab opener being welded adjacent a second end thereof opposite said one end to the sheet material container wall panel by means of a high energy density welding process to provide a fulcrum. The tab opener is welded at a location intermediate its ends to the movable wall portion whereby tearing along the scoreline is initiated by Class 2 lever action upon lifting the tab opener with the handle means. In another, similar embodiment, the second end of the tab opener is located in the vicinity of a hinge material portion connecting the movable wall portion to the sheet material wall with this second end of the tab opener serving as a fulcrum during opening by a Class 2 lever action.

These and other objects, features and advantages of the present invention will become more apparent from the following description when taken in connection with the accompanying drawings which show, for purposes of illustration only, several embodiments in accordance with the invention.

BRIEF DESCRIPTION OF THE DRAWINGS

FIG. 4 is a top plan view of another, preferred form of an easy-open structure for containers according to the invention similar to the embodiment in FIG. 3 except that the elongated weld area is formed by a plurality of laser welds positioned in spaced relationship;

FIG. 5 is a sectional view taken along line 5—5 of FIG. 4;

FIG. 6 is a sectional view similar to FIG. 5 but showing the handle end of the tab opener in a lifted position with tearing having been initiated along the scoreline of the end closure adjacent the working end of the tab opener by Class 1 lever action;

FIG. 7 is a sectional view similar to FIG. 6 but showing the tab torn along a portion of the scoreline as it is pulled out of conforming contour with the remainder of the end closure;

FIG. 16 is a top sectional view taken along the line 16—16 of FIG. 15;

FIG. 17 is a sectional view similar to FIG. 15 but showing the tab torn along a portion of the scoreline as the handle end is pulled in the direction of arrow 315;

FIG. 18 is a sectional view similar to FIG. 15 but showing the tab pulled back more fully by means of the tab opener;

DETAILED DESCRIPTION OF THE DISCLOSED EMBODIMENTS

Figure 1:
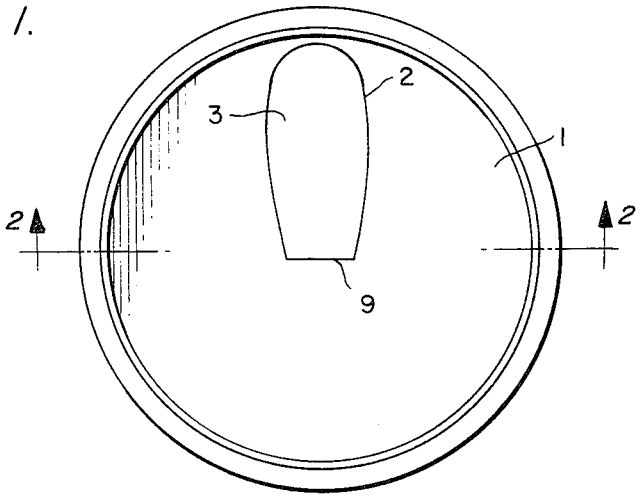
FIG. 1 is a top plan view of a sheet metal container end closure for use in one embodiment of the invention wherein a scoreline formed in the end closure outlines a tab adapted to be moved out of conforming contour with the remainder of the end closure for opening the container.
Figure 2:
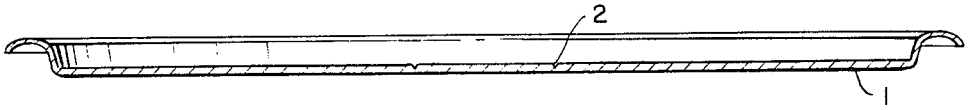
FIG. 2 is a sectional view taken along lines 2—2 of FIG. 1.

Referring now to the drawings, an easy-open structure for containers according to one embodiment of the invention comprises a sheet material container wall panel 1 in the form of a container end closure as illustrated in FIGS. 1 and 2. The sheet material panel 1 may be formed of steel, aluminum, plastic, laminates thereof or other suitable material as discussed more fully below. The panel 1 is formed with a scoreline 2 outlining a movable wall portion 3 in the form of a tab adapted to be moved out of conforming contour with the remainder of the sheet metal wall panel so as to provide a drinking or pouring opening for the end of a beverage container.

The scoreline 2 completely circumscribes the movable wall portion 3 in the illustration and the residual may be of increasing thickness near the radially inner portions so as to increasingly resist tearing to prevent complete removal from the panel 1. The panel 1 is scored only slightly, or optionally not at all, along the straight portion 9 to provide a hinge for movement of the portion 3 relative to the panel 1 which retains the portion 3 on the container after opening. The scoreline 2 is formed from the top or outer surface of the panel 1 in the illustrated embodiment but may be formed from below instead.

Figure 3:
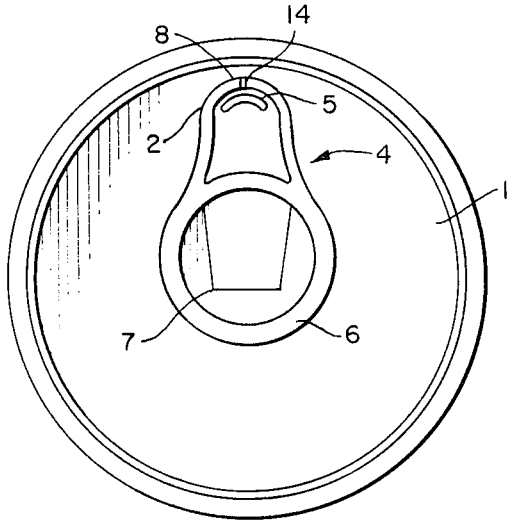
FIG. 3 is a top plan view of an easy-open structure for containers according to one embodiment of the invention wherein an elongated tab opener is welded to the tab of the sheet metal end closure of FIG. 1 at an elongated weld area by a continuous laser weld.

The wall panel or beverage can end 1 of FIGS. 1 and 2 is provided with an elongated tab opener 4 as shown in FIG. 3 for moving the movable wall portion 3 out of conforming contour with the remainder of the wall panel. The tab opener is preferably formed of the same or similar sheet material as the wall panel 1 and may be steel or aluminum, for example. It is generally flat with curled edges for reinforcement and a chisel point 15 at its working end 8. In the disclosed embodiment both the wall panel and tab opener are formed from steel sheet material.

Figure 22:
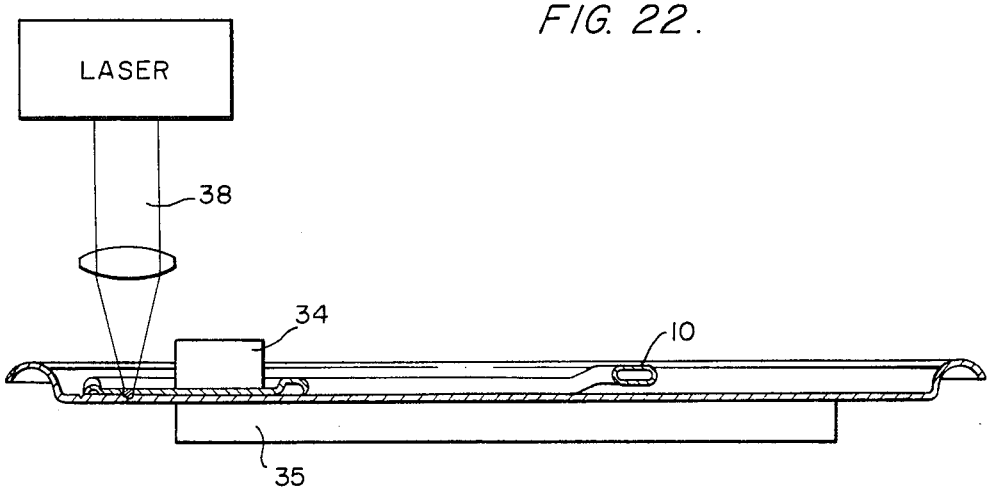
FIG. 22 is a view similar to FIG. 5 and schematically illustrating the clamped workpieces in position for laser welding.

According to the method of the invention the tab opener 4 is welded to the movable wall portion 3 by means of a high energy density welding process, wherein the energy density is at least on the order of $10^6$ watts/inch$^2$, so as to form an elongated weld area 5 formed by a continuous weld extending transverse to the longitudinal direction of the tab opener and in close spaced relationship to a portion of the scoreline 2 where tearing is initiated with movement of the tab opener as illustrated in FIG. 3. The portion of the scoreline where tearing is initiated is curvilinear and the elongated weld area extends substantially along the contour of this curvilinear portion of the scoreline in close spaced relationship thereto, that is, the weld area is substantially parallel to the scoreline portion. The welding is preferably performed by laser welding with a 400 watt NdYAG laser. The weld width is 0.008 inch or wider. A 2 kw gas laser may also be used wherein, for example, welding can be accomplished using a 500 watt laser beam focused to a diameter of 0.004 inch. The tab opener and wall panel are maintained in contact during welding by suitable clamps, illustrated schematically at 34 and 35 in FIG. 22, as the laser beam 38 and clamped components are moved relative to one another along the desired weld area 5.

The tab opener 4 is formed with a handle 6 at one end thereof for moving the movable portion out of conforming contour with the remainder of the sheet metal wall panel 1. The handle 6 is generally circular in form and has a central aperture 7 through which a finger may be inserted after the handle has been initially lifted for pulling the tab 3 back. The opposite, working end 8 of the tab opener 4 is positioned over the portion of the scoreline where tearing is to be initiated. The elongated weld area 5 is positioned along the tab opener 4 in close spaced relationship to the working end 8 and serves as a fulcrum whereby tearing along the scoreline 2 is initiated by Class 1 lever action with a relatively high mechanical advantage upon lifting the handle end of the tab opener. Several reinforcing ribs, not shown, may be formed in the tab opener to provide additional rigidity. The handle 6 at one end of the tab opener 4 may be bent upward slightly out of the plane of the remainder of the tab opener as shown at 10 in FIG. 5 to make it easier to grasp the handle and lift it. Additionally, or alternatively, a recess or dished portion, not shown, could be provided in the wall panel 1 beneath the end of the handle 6 for this purpose.

If the tab opener 4 were attached to the wall panel 1 by means of the conventional technique of riveting instead of according to the method of the present invention, it would be necessary for the sheet metal of the panel to be relatively ductile to permit formation of a rivet head therefrom. For this reason, ductile aluminum sheet material has frequently been used for wall panels or container ends. The use of steel sheet materials has been restricted to steels having a relatively low temper and low tensile strength, that is, a tensile strength of less than approximately 60,000 psi and a temper of from T1 to T4. One such material is a low carbon steel, either plain or tin plated, having a thickness of 0.012 inch. The continuously annealed, tempered material (T4) may be formed from 109 lb. plate material. With the present invention, however, it is possible to use not only a relatively ductile aluminum or steel sheet material for the wall panel but also a higher tensile strength, less ductile sheet material such as a high tensile double reduced low carbon steel. This is advantageous because a high tensile strength material enables a thinner sheet material to be used for the wall panel. For example, with the present invention the sheet material wall panel can be formed from an 85 lb., double reduced, continuously annealed steel material having a thickness of 0.0094 inch or less. Therefore, a significant cost savings in the manufacture of ends for containers can be achieved with the present invention.

The steel, aluminum or other sheet materials of the wall panel may be plain or coated without adversely affecting the weld quality in most instances. On the other hand, sheet metal with non-conductive or high resistive coatings cannot be electrical resistance welded with repeatable results. High welding speed is also possible with laser welding according to the invention so that cans can be manufactured at rates of 600 per minute or more with appropriate optics and control of the laser. Also, in the case of internally coated ends, the sheet metal panels for the container ends may be scored from the bottom or inner side so that a single coating after welding will ensure a completely coated container end. Alternatively, the laser welding can be controlled so that weld penetration extends only partially through the thickness of the container end from the outside of the container end so as not to damage an existing coating on the inside of the container end thereby avoiding the necessity of a postweld coating operation.

The form of the invention illustrated in FIGS. 4–9 is like that shown in FIG. 3 except that the elongated weld area 5 is formed by a plurality of laser welds positioned in spaced relationship along the length of the elongated weld area. The spot size of these welds and also the width of the continuous weld shown in FIG. 3 can be made very small by appropriate focusing of the laser beam as noted above. Because of this and the relatively small weld heat affected zone with such a high energy density welding process, the weld or welds along the elongated weld area can be consistently placed in close spaced relationship to the scoreline to maximize the mechanical advantage of the lever action. In particular, the weld or welds along the elongated weld area can be spaced a distance less than one quarter of an inch from the scoreline and preferably one-eighth of an inch or less depending upon the specific configuration of the tab opener. Actually, the laser can be precisely controlled to position the weld within a few thousandths of an inch from the scoreline if the tab opener configuration permits. Thus, with a tab opener having a length of one and one-quarter inches, a mechanical advantage of at least between 5 and 10 to 1 can readily be attained because of the placement arrangements made possible by the invention. The relatively high mechanical advantage makes it easier to lift the handle end of the tab opener and initiate opening of the container.

The elongated configuration of the weld or connection means between the tab opener and the wall panel, which in this case extends transverse to the longitudinal direction of the tab opener near the working end of the tab opener, also serves to align the force applied by the working end of the tab opener over the length of the welded area during lifting of the handle 6. The working end 8 of the tab opener is preferably shaped so that it is directly over a considerable length 11 of the scoreline, see FIG. 8, whereby a relatively large portion of the tab 3 is initially torn along the scoreline under pressure during the lifting of the handle of the tab opener. The high mechanical advantage of the lever action referred to above facilitates this initial severing along the length 11. After the handle 6 is lifted to the position shown in FIG. 6 it is pulled in the direction of arrow 15 in FIG. 7 to progressively tear the movable wall portion or tab 3 from the wall panel along the length of scoreline indicated at 12 in FIG. 8. The pulling force which is required in this regard is reduced in comparison to that which would be required if the wall portion were initially torn along only a relatively short length of the scoreline instead of along length 11.

Figure 8:
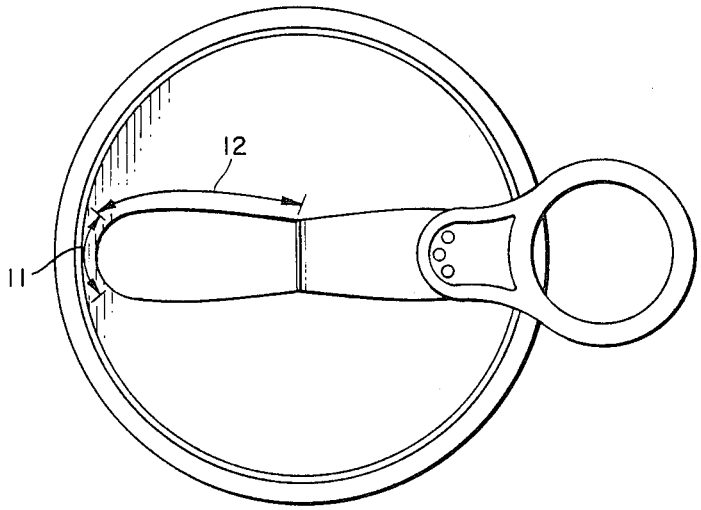
FIG. 8 is a top plan view of the easy-open structure for containers of FIG. 4 wherein the tab has been pulled back fully by means of the tab opener such that the tab is torn from the end closure along the entire length of the tab but remains attached to the end closure by a hinged metal portion.
Figure 9:
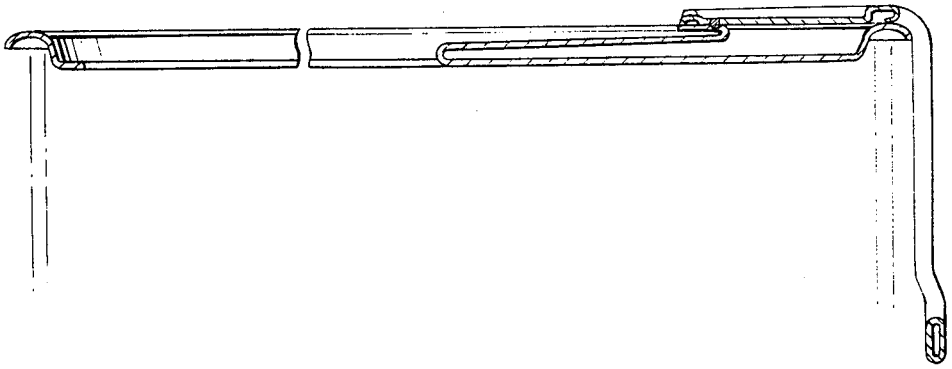
FIG. 9 is a sectional view similar to FIG. 7 but showing the tab pulled back fully in the manner shown in FIG. 8 and wherein the tab opener has been bent downwardly about the edge of the end closure.

When the movable wall portion 3 is torn along the scoreline 2 to the position illustrated in FIG. 8, it may be bent downwardly along the side of the container, not shown, to a position illustrated in FIG. 9.

Figure 10:
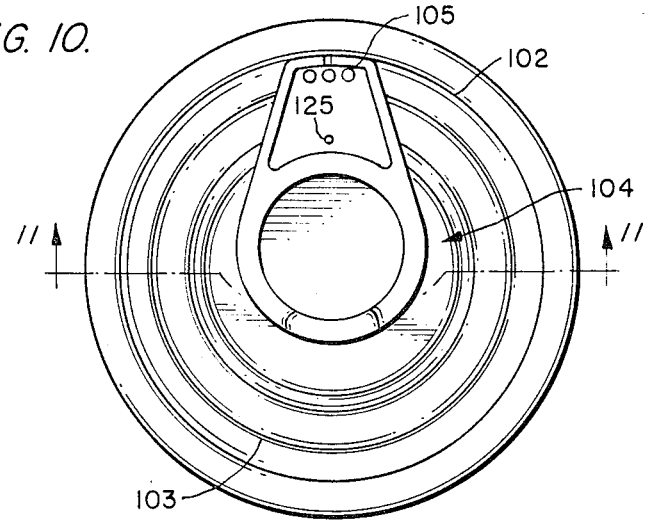
FIG. 10 is a top plan view of another embodiment of the invention wherein the movable wall portion of the end closure extends over essentially the entire container end and is completely circumscribed by a scoreline so that it may be removed from the container end.
Figure 11:
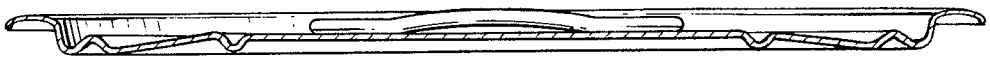
FIG. 11 is a sectional view taken along the lines 11—11 of FIG. 10.

In another embodiment of the invention shown in FIGS. 10 and 11, the movable wall portion 103 extends over essentially the entire container end and is circumscribed by the scoreline 102 so that the movable wall portion may be completely removed from the container end by means of the elongated tab opener 104. In this embodiment the elongated weld area 105 is formed by a plurality of laser welds positioned in spaced relationship along the length of the elongated weld area. The elongated weld area extends transverse to the longitudinal direction of the tab opener and is substantially parallel to the curvilinear contour of the adjacent scoreline. The opening motion of the structure in FIGS. 10 and 11 is similar to that described above except that after lifting the handle end of the tab opener 104 to initiate opening and pulling the tab opener to tear the wall portion 103 along the scoreline 102, the wall portion is completely removed from the container end rather than being retained thereon by a hinge portion as in the previously described embodiments.

As another feature of the invention illustrated in the embodiment of FIGS. 10 and 11, a means is provided for venting the container as the handle end of the tab opener is lifted. In particular, this means for venting includes an additional laser weld 125 connecting the tab opener to a vent portion of the movable wall portion 103 between the elongated weld area and the handle end whereby the vent portion is torn from the movable wall portion by a Class 2 lever action to vent the container upon lifting the handle of the tab opener. If desired, an additional, annular scoreline, not shown, may be formed in the movable wall portion around the additional weld 125 so as to outline the vent portion. Upon lifting the tab opener, the vent portion is torn from the movable wall portion along the additional scoreline. Such an arrangement is particularly advantageous in that it eliminates failures at vent scorelines associated with known arrangements wherein a rivet connects the tab opener to the wall panel with small vent scorelines being provided adjacent thereto for venting the container.

Figure 12:
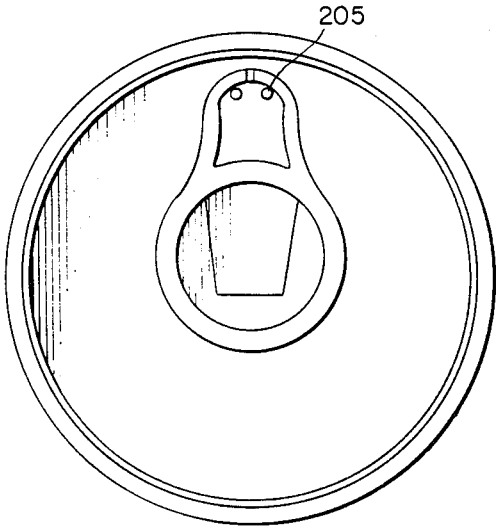
FIG. 12 is a top plan view of a slightly different form of the invention wherein the elongated weld area is formed by a pair of laser welds which are spaced from one another along a line extending perpendicular to the longitudinal direction of the movable wall portion.
Figure 13:
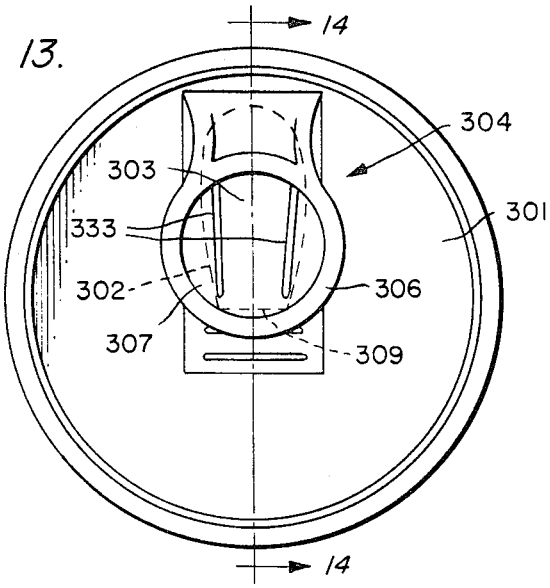
FIG. 13 is a top plan view of another embodiment of the invention wherein the elongated tab opener is welded to both the sheet metal container wall panel and the movable wall portion or tab.
Figure 14:
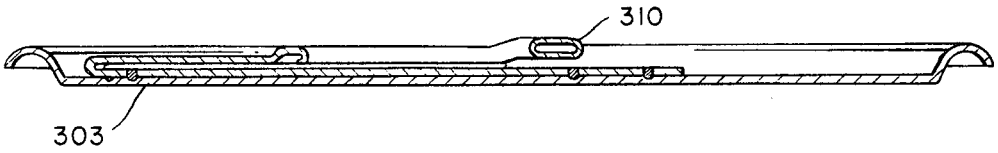
FIG. 14 is a sectional view taken along line 14—14 of FIG. 13.
Figure 15:
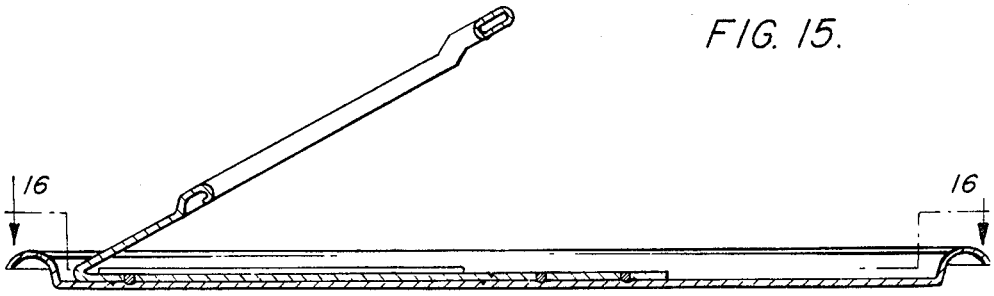
FIG. 15 is a sectional view similar to FIG. 14 but showing the handle end of the tab opener in a lifted position.

The form of the invention illustrated in FIG. 12 is like that shown in FIGS. 4–9 except that the elongated weld area is formed by two laser welds 205 positioned in close spaced relationship to the scoreline and along a line extending perpendicular to the longitudinal direction of the tab and tab opener.

Figure 19:
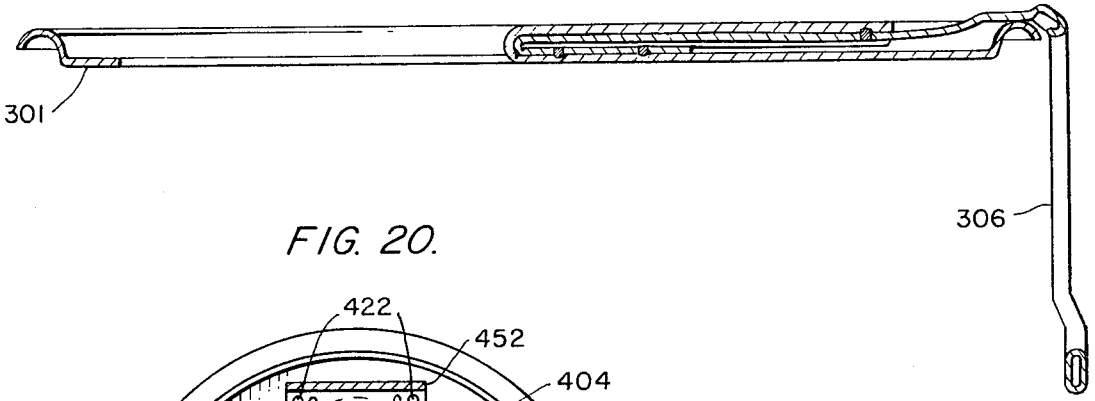
FIG. 19 is a sectional view similar to FIG. 18 but showing the tab pulled back fully with the tab opener bent downwardly about the edge of the end closure.

In the form of the invention illustrated in FIGS. 13–19, the easy-open structure for containers comprises an elongated tab opener 304 which is provided with a handle 306 in the form of a ring pull adjacent one end thereof for moving the movable wall portion 303 out of conforming contour with the sheet metal wall panel 301. The movable wall portion 303 is in the form of a tab which provides a drinking or pouring opening 313 once the tab has been moved out of conforming contour with the wall panel. The tab opener 304 is connected by laser welds 320, FIG. 16, adjacent a second end thereof which is opposite said one end to the sheet metal container wall panel 301 to provide a fulcrum. The tab opener is also connected intermediate its ends to the movable wall portion at an elongate weld area 305 formed by a continuous laser weld whereby tearing along the scoreline 302 is initiated by Class 2 lever action upon lifting the tab opener with the handle 306. The laser weld 305 is positioned in close spaced relationship to the scoreline 302. The tab opener is reinforced by ribs 333 formed therein. The opening action is depicted sequentially in FIGS. 14, 15, 17, 18 and 19 which respectively show the tab opener in the initial, closed position (FIG. 14), a position where the handle 306 has been lifted (FIG. 15), a position where the tab opener 304 has been pulled in the direction of arrow 35 to initiate tearing along the scoreline 302 (FIG. 17), a completely open position (FIG. 18), and a final position where the tab opener has been folded down along the side of a container (FIG. 19). The tab opener could be folded over or under instead of down along the side of the container.

In this embodiment of the invention the scoreline 302 may be formed at least essentially through the entire thickness of the sheet metal container wall panel about at least a substantial portion of the movable wall portion or tab 303. For example, the depth of scoring may be in the range of 80 to 85% or more so that the movable wall portion can be easily moved out of conforming contour with the remainder of the sheet metal wall panel by means of the tab opener. The scoreline 302 may also be formed through the entire thickness of the sheet metal container wall panel about at least substantially the entire outline of the movable wall portion. Thus, the term scoreline is used herein in a general sense to encompass the formation of a score or cut through a portion of the thickness of the wall panel or through the entire thickness thereof. The scoreline in the illustrated embodiment incompletely circumscribes the movable wall portion so that a hinge metal portion 309 remains for retaining the movable wall portion on the container wall panel after opening. A scoreline 321 for bending is also provided in the tab opener adjacent the second end thereof and proximate the hinge metal portion 309 of the scoreline.

Figure 21:
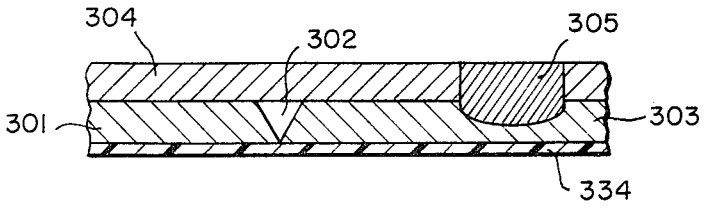
FIG. 21 is a sectional view of a portion of a sheet metal container end closure of the invention wherein the scoreline extends entirely through the sheet metal wall panel with an epoxy coating material being provided on the inner or lower side to prevent leakage through the end closure at the scoreline.

As shown in FIG. 16, the tab opener 304 is laser welded to the sheet metal container wall panel 301 at a plurality of spaced locations 322 along the movable wall portion so that the tab opener, by means of welds 320 and 322, resists outward movement of the movable wall portion from pressures within a container. The weld size at the staggered, spaced locations 322 is relatively small to allow successive breaking thereof during the Class 2 lever action upon opening. In the event the scoreline is formed through the entire thickness of the sheet metal container wall panel about at least a portion of the movable wall portion, a coating 334 may be applied to the underside of the sheet metal container wall panel in the area of the scoreline as shown in FIG. 21 for resisting leakage through the container wall panel at the scoreline. A suitable coating is an epoxy coating material which is spray coated on the panel and thereafter heated and cured. Such a coating procedure may be performed subsequent to welding to cover the scoreline as well as repair any coating in the weld areas or it may be applied prior to welding where the laser weld penetration is accurately controlled to avoid damaging the coated material. This latter case is illustrated in FIGS. 14, 15, 17, 18 and 19 and also FIG. 21 wherein it is seen that the weld 305 extends only partially through the thickness of the movable wall portion 303.

The elongated weld area 305 shown in FIG. 16 is illustrated as a continuous laser weld. However, a plurality of spaced laser welds such as those shown in FIGS. 4 and 12 may be employed instead. Also, the weld area could extend along a longitudinal direction of the scoreline from a location in close spaced relationship to a portion of the scoreline where tearing is initiated with movement of the tab opener.

Figure 20:
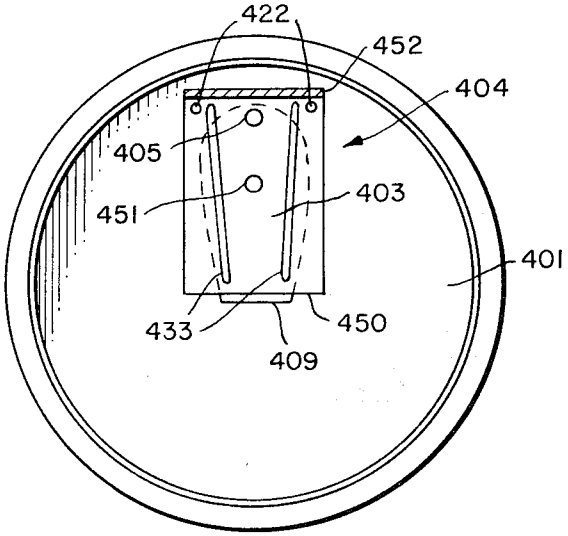
FIG. 20 is a top sectional view like FIG. 16 of another embodiment of the invention wherein the end of the tab opener opposite the handle serves as a fulcrum for Class 2 lever action during opening.

The embodiment of the invention illustrated in FIG. 20 is similar to that in FIGS. 13–19 except that the tab opener 404 in FIG. 20 is not welded at its inner end 450 to the sheet metal wall panel 401 by means of laser welds as in the embodiment of FIGS. 13–19. Instead, the inner end 450 of the tab opener is positioned adjacent a hinge metal portion 409 of the scoreline about the movable wall portion or tab 403 and, in conjunction with the hinge portion 409 serves as a fulcrum during opening by Class 2 lever action. After opening, the tab 403 and tab opener 404 are retained on the sheet metal container end panel 401 by means of the hinge metal portion 409. Except for the hinge portion 409, the scoreline may extend completely or substantially through the panel 401 whereby opening of the container can be easily accomplished. A coating may be applied to the underside of the panel 401 in the area of the through scoreline for resisting leakage as previously discussed.

The tab opener 404 is laser welded to the sheet metal wall panel 401 at two locations 422 adjacent its outer or handle end 452. Relatively larger laser welds 405 and 451 connect the tab opener to the tab 403. The weld 405 is located in close spaced relationship to a portion of the scoreline where tearing is initiated with movement of the tab opener and the weld 451 is positioned inwardly from the weld 405 along the longitudinal direction of the tab 403 and tab opener 404. The laser welds 422, 405 and 451 and the hinge metal portion 409 resist expulsion of the tab 403 from pressures within a container in the case where the scoreline extends substantially or completely through the panel 401.

The four laser welds shown in FIG. 20 can be formed simultaneously using a single beam from a pulsed laser with successive beam splitters to obtain four beams which then pass through a single lens. The lens focuses each beam in a different position to obtain four focused spots of 0.010 inch diameter, for example. The single beam from the laser is split so that the beams for forming the respective welds 405 and 451 are provided with a greater energy than those beams for producing the relatively smaller welds 422. As in the embodiment of FIGS. 13–19, the weld size of welds 422 is relatively small to allow the welds to break during the Class 2 lever action upon opening. One or more of the welds 422 can be made to function as a vent by forming the weld completely through the panel 401 so that it can be pulled out during opening.

Further, according to the invention it is possible to form high energy density welds such as laser welds between the tab opener and the wall panel which overlap or encompass the scoreline and thereby serve to connect the tab opener to both the movable wall portion and the surrounding wall panel. The number of welds can be reduced in this manner.

While I have shown and described several embodiments in accordance with the present invention, it is understood that the same is not limited thereto but is susceptible of numerous changes and modifications as would be known to those skilled in the art, given the present disclosure. For example, rather than laser welding, another high energy density welding process, such as electron beam welding or a combination of high energy density welding and conventional processes such as arc augmented laser welding could be used in the method of the invention. Also, instead of welding the tab opener to the movable wall portion over an elongated weld area formed by a continuous weld or a plurality of spaced welds, it is possible according to the invention to join the tab opener to the movable wall portion with a single high energy density weld, such as a laser weld. I therefore do not wish to be limited to the details shown and described herein but intend to cover all such changes and modifications as are encompassed by the scope of the appended claims.

I claim:

1. A method of forming an easy-open structure for containers comprising the steps of providing a sheet material wall panel having a scoreline formed therein outlining a movable wall portion which is adapted to be moved out of conforming contour with the remainder of the sheet material wall panel, providing a tab opener for moving the movable wall portion out of conforming contour with the remainder of the wall panel, one end of said tab opener serving as a handle for moving the movable wall portion out of conforming contour with the remainder of the sheet material wall panel and an opposite end of said tab opener serving as a working end for initiating tearing at a portion of said scoreline by Class 1 lever action upon lifting the handle end of said tab opener, positioning said tab opener adjacent said sheet material wall panel so that said working end of the tab opener is located over and extends along said portion of the scoreline where tearing is to be initiated, and welding said tab opener to said movable wall portion along an elongated weld area by means of a high energy density laser welding process wherein the energy density is at least on the order of $10^6$ watts per square inch, with said elongated weld area being located between said tab opener ends in close spaced relationship to the working end of the tab opener and to said portion of the scoreline where tearing is to be initiated, and said elongated weld area extending longitudinally in a direction transverse to the longitudinal direction of the tab opener to provide a fulcrum for said Class I lever action when the handle end of said tab opener is lifted.

2. A method of forming an easy-open structure according to claim 1, wherein at least a part of said weld area is located approximately one-eighth of an inch or less from said scoreline.

3. A method of forming an easy-open structure according to claim 1, wherein said elongated weld area extends substantially parallel to said portion of the scoreline where tearing is initiated.

4. A method of forming an easy-open structure according to claim 1, wherein said welding step includes forming a plurality of laser welds positioned in spaced relationship along the length of the elongated weld area.

5. A method of forming an easy-open structure according to claim 1, wherein said welding step comprises forming a continuous elongated weld which extends along the length of the elongated weld area.

6. A method of forming an easy-open structure according to claim 1, wherein an additional weld is formed connecting said tab opener to a vent portion of said movable wall portion, said vent portion being located between said elongated weld area and said handle end so that said vent portion can be torn from the movable wall portion by a Class 2 lever action to vent said container upon lifting the handle end of the tab opener.

7. A method of forming an easy-open structure according to claim 1, wherein said scoreline circumscribes said movable wall portion so that a hinge material portion remains for retaining the movable wall portion on the sheet material wall panel after opening.

8. A method of forming an easy-open structure according to claim 1, wherein said welding step includes simultaneously forming a plurality of laser welds positioned in spaced relationship along said elongated weld area.

9. A method of forming an easy-open structure according to claim 1, wherein said tab opener is laser welded to an outer side of the movable wall portion from the outer side of the movable wall portion so that the weld penetration extends only partially through the thickness of the wall portion whereby postweld coating of the inner side of said movable wall portion can be avoided.

10. A method of forming an easy-open structure for containers comprising the steps of providing a sheet material wall panel having a scoreline formed therein outlining a movable wall portion which is adapted to be moved out of conforming contour with the remainder of the sheet material wall panel, providing a relatively rigid tab opener which can function as a lever for moving the movable wall portion out of conforming contour with the remainder of the wall panel, said tab opener being provided with handle means adjacent one end thereof for moving the movable wall portion out of conforming contour with the remainder of the sheet material wall panel, and said tab opener including a portion at a second opposite end thereof which serves as a fulcrum during opening by Class 2 lever action, positioning said tab opener adjacent said remainder of the sheet material wall panel and said movable wall portion, and welding said tab opener to both said movable wall portion and said remainder of the sheet material wall panel adjacent said movable wall portion with a high energy density laser welding process wherein the energy density is at least on the order of $10^6$ watts per square inch, wherein the tab opener is laser welded to said movable wall portion at a location intermediate said ends of the tab opener and in close spaced relationship to a portion of said scoreline where tearing is to be initiated by said Class 2 lever action upon lifting the tab opener with said handle means.

11. A method of forming an easy-open structure according to claim 10, wherein said tab opener is laser welded to an outer side of the movable wall portion from the outer side of the movable wall portion so that the weld penetration extends only partially through the thickness of the wall portion whereby postweld coating of the inner side of said movable wall portion can be avoided.

12. A method of forming an easy-open structure according to claim 10, wherein said welding step includes laser welding the tab opener to said remainder of the sheet material wall panel at a plurality of spaced locations adjacent the movable wall portion so that said tab opener resists outward movement of said movable wall portion from pressures within a container, the weld size at said spaced locations being relatively small to allow breaking thereof during opening.

13. A method of forming an easy-open structure according to claim 12, wherein said scoreline is formed at least essentially through the entire thickness of the sheet material wall panel about a substantial portion of the movable wall portion so that the movable wall portion can be easily moved out of conforming contour with the remainder of the sheet material wall panel.

14. A method of forming an easy-open structure according to claim 13, wherein said scoreline is formed through the entire thickness of the sheet material wall panel about at least substantially the entire outline of said movable wall portion.

15. A method of forming an easy-open structure according to claim 14, wherein a coating is applied to said sheet material wall panel in the area of said scoreline for resisting leakage through said sheet material wall panel at said scoreline.

16. A method of forming an easy-open structure according to claim 10, wherein said welding includes laser welding said tab opener to the remainder of said sheet material wall panel adjacent said second end of the tab opener, and wherein a scoreline for bending is formed in said tab opener adjacent the second end thereof at said fulcrum.

17. An easy-open structure for containers comprising a sheet material wall panel having a scoreline formed therein outlining a movable wall portion to be moved out of conforming contour with the remainder of the wall panel, and a tab opener for moving the movable wall portion out of conforming contour with the remainder of the wall panel, said tab opener being welded to said movable wall portion along an elongated weld area formed by high energy density laser welding wherein the energy density is at least on the order of $10^6$ watts per square inch, wherein said tab opener is elongated with one end thereof serving as a handle for moving the movable wall portion out of conforming contour with the remainder of the sheet material wall panel and the other end of said tab opener serving as a working end which is positioned over and extends along the portion of the scoreline where tearing is to be initiated, said elongated weld area extending transverse to the longitudinal direction of the tab opener and being positioned along said tab opener in close spaced relationship to said working end and to said portion of the scoreline where tearing is to be initiated, said elongated weld area serving as a fulcrum when tearing is initiated along said scoreline by Class 1 lever action with a relatively high mechanical advantage upon lifting the handle end of the tab opener.

18. An easy-open structure for containers according to claim 17, wherein at least part of said weld area is located within approximately ⅛th of an inch or less from said scoreline.

19. An easy-open structure for containers according to claim 17, wherein said elongated weld area extends substantially parallel to said portion of the scoreline where tearing is to be initiated.

20. An easy-open structure for containers according to claim 17, wherein said elongated weld area is formed by two laser welds which are spaced apart and positioned in close spaced relationship to the scoreline and along a line extending perpendicular to the longitudinal direction of the tab opener.

21. An easy-open structure for containers according to claim 17, wherein said elongated weld area includes a plurality of welds positioned in spaced relationship along the length of the elongated weld area.

22. An easy-open structure for containers according to claim 17, wherein said elongated weld area is formed by a continuous elongated weld.

23. An easy-open structure for containers according to claim 17, wherein the handle end of said tab opener is generally circular in form and has a central aperture through which a finger may be inserted after the handle end of the tab opener has been lifted.

24. An easy-open structure for containers according to claim 17, wherein means are provided for venting said container as the handle end of the tab opener is lifted.

25. An easy-open structure for containers according to claim 24, wherein said means for venting includes an additional weld area connecting said tab opener to a vent portion of said movable wall portion between said elongated weld area and said handle end whereby said vent portion is torn from the movable wall portion by a Class 2 lever action to vent said container upon lifting the handle end of the tab opener.

26. An easy-open structure for containers according to claim 25, wherein said means for venting further includes an additional scoreline formed in said movable wall portion around said additional weld area and outlining said vent portion, said additional scoreline being ruptured when said vent portion is torn from the movable wall portion.

27. An easy-open structure for containers according to claim 17, wherein said wall panel is formed of steel sheet metal.

28. An easy-open structure for containers according to claim 17, wherein said sheet material container wall panel is an end for a container.

29. An easy-open structure for containers according to claim 28, wherein said movable wall portion extends over essentially the entire container end and is completely circumscribed by said scoreline so that the movable wall portion may be removed from said container end.

30. An easy-open structure for containers according to claim 28, wherein said movable wall portion is in the form of a tab which encompasses only a portion of said container end.

31. An easy-open structure for containers according to claim 30, wherein said scoreline does not completely circumscribe said tab so that a hinge material portion remains for retaining the tab and tab opener on the container end after opening.

32. An easy-open structure according to claim 17, wherein said tab opener is laser welded to an outer side of the movable wall portion with the weld penetration extending only partially through the thickness of the wall portion.

33. An easy-open structure for containers comprising a sheet material wall panel having a scoreline formed therein outlining a movable wall portion to be moved out of conforming contour with the remainder of the wall panel, and a relatively rigid tab opener which can function as a lever for moving the movable wall portion out of conforming contour with the remainder of the wall panel, said tab opener being provided with handle means adjacent one end thereof for moving the movable wall portion out of conforming contour with the remainder of the sheet material wall panel and said tab opener including a portion at a second opposite end thereof which serves as a fulcrum during opening by Class 2 lever action, and wherein said tab opener is laser welded to both said movable wall portion and said remainder of the sheet material wall panel adjacent said movable wall portion by a high energy density laser welding wherein the energy density is at least on the order of $10^6$ watts per square inch, said tab opener being laser welded to said movable wall portion at a location intermediate said ends of the tab opener and in close spaced relationship to a portion of said scoreline where tearing is to be initiated by Class 2 lever action upon lifting the tab opener with said handle means.

34. An easy-open structure according to claim 33, wherein said tab opener is laser welded to an outer side of the movable wall portion with the weld penetration extending only partially through the thickness of the wall portion.

35. An easy-open structure for containers according to claim 33, wherein said tab opener is laser welded to said remainder of the sheet material wall panel adjacent said movable wall portion at said second end of said tab opener, and wherein a scoreline for bending is formed in said tab opener adjacent the second end thereof at said fulcrum.

36. An easy-open structure for containers according to claim 28, wherein said scoreline is formed at least essentially through the entire thickness of the sheet metal container wall panel about at least a substantial portion of said movable wall portion so that the movable wall portion can be easily moved out of conforming contour with the remainder of the sheet material wall panel.

37. An easy-open structure for containers according to claim 36, wherein said scoreline is formed through the entire thickness of the sheet material container wall panel about at least a substantial portion of said movable wall portion.

38. An easy-open structure for containers according to claim 37, wherein a coating is applied to said sheet material container wall panel in the area of said scoreline for preventing leakage through said container wall panel at said scoreline.

39. An easy-open structure for containers according to claim 36, wherein said scoreline does not completely circumscribe said movable wall portion so that a hinge material portion remains for retaining the movable wall portion on the container wall panel after opening.

40. An easy-open structure for containers according to claim 33, wherein said tab opener is laser welded to said remainder of the sheet material container wall panel at a plurality of spaced locations adjacent said movable wall portion so that said tab opener resists outward movement of said movable wall portion from pressures within a container, the weld size at said spaced locations being relatively small to allow breaking thereof during opening.

* * * * *